US006098769A

United States Patent [19]

Yen

[11] Patent Number: 6,098,769

[45] Date of Patent: Aug. 8, 2000

[54] ROLLING LUGGAGE WITH DETACHABLE NOTEBOOK CARRIER BAG

[75] Inventor: Elton Yen, El Monte, Calif.

[73] Assignee: Sumdex Inc., El Monte, Calif.

[21] Appl. No.: 09/277,368

[22] Filed: Mar. 27, 1999

[51] Int. Cl.[7] ..... A45C 5/14; A45C 13/10; A45C 13/26

[52] U.S. Cl. ..... 190/108; 190/18 A; 190/102; 190/110

[58] Field of Search ..... 190/102, 108, 190/109, 110, 18 A; 150/111

[56] References Cited

U.S. PATENT DOCUMENTS

| | | | |
|---|---|---|---|
| D. 267,677 | 1/1983 | Pelavin | 190/102 X |
| 954,840 | 4/1910 | Wiedemann | 190/102 X |
| 3,729,038 | 4/1973 | Ekeson | 190/110 |
| 4,206,835 | 6/1980 | Shapiro | 190/102 X |
| 4,420,068 | 12/1983 | Gerch | 190/108 X |
| 4,424,841 | 1/1984 | Smith | 190/108 X |
| 4,685,546 | 8/1987 | Sadow | 190/108 X |
| 5,240,106 | 8/1993 | Plath | 190/102 X |
| 5,341,928 | 8/1994 | Jones et al. | 190/108 X |
| 5,354,131 | 10/1994 | Mogil | 190/108 X |
| 5,547,052 | 8/1996 | Latshaw | 190/108 |
| 5,944,155 | 8/1999 | Geary | 190/110 X |
| 5,971,119 | 10/1999 | Chi | 190/110 X |

FOREIGN PATENT DOCUMENTS

| | | | |
|---|---|---|---|
| 2342895 | 3/1975 | Germany | 190/110 |
| 3600794 | 8/1986 | Germany | 190/110 |

*Primary Examiner*—Sue A. Weaver
*Attorney, Agent, or Firm*—Raymond Y. Chan; David and Raymond

[57] ABSTRACT

A rolling luggage with a notebook carrier bag detachably attached to a front side of the rolling luggage, wherein a first fastening means is secured at a top side of said rolling luggage. The notebook carrier bag includes a base supporting panel, a first and a second carrying container provided on an outer surface of the base supporting panel, a handle means for easy holding, and a first connector secured to one end of the notebook carrier bag for detachably connecting with the first fastening means so as to combine the notebook carrier bag with the rolling luggage to form a single piece of luggage during traveling and transportation. Normally, the notebook carrier bag can be detached from the rolling luggage. Also, since the first carrying container and the second carrying container are foldably connected together, the first carrying container and the second carrying container can be folded up overlappedly to form an independent notebook carrier bag.

6 Claims, 5 Drawing Sheets

ROLLING LUGGAGE WITH DETACHABLE NOTEBOOK CARRIER BAG

FIELD OF THE PRESENT INVENTION

The present invention relates to luggage, and more particularly to a rolling luggage to which a detachable notebook carrier bag can be firmly mounted thereto and traveled with the rolling luggage as a single piece of luggage.

BACKGROUND OF THE PRESENT INVENTION

Travelling between states or countries becomes a daily matter to most of the traders. In order to help the travelers to transport their hand-carry luggage easier with less effort and labor, a kind of rolling luggage is developed in the market, which comprises a luggage bag, a pair of rolling wheels rotatably mounted to two bottom sides of the luggage bag, and a carrier device attached to a rear side of the luggage bag, wherein the carrier device comprises an extensible handle bar that can be upwardly extended for easy handling. The development of such rolling luggage enables the traveler to carry their clothing and daily needs simply by pulling or pushing.

To most of the business people, trading travelers, and corporate employees, notebook computer is another main equipment to carry along for information memory, documentation, data operation, and communication. Since each busy traveler may need the notebook computer to work on during the air or ground transporting, the notebook is typically hand carried by the traveler in a notebook carrier bag. Even though the traveler may only need the notebook computer after he or she arrives the designation place, the traveler still pack the notebook computer in the notebook carrier bag because it not only protects the notebook when it is not in use but also can carry computer accessories, such as floppy disks and batteries, and other documents. However, the notebook computer will occupy one hand of the traveler. The best a traveler can do is to carry the notebook carrier bag by shouldering.

Some travelers try to hang the notebook carrier bag to the rolling luggage. It seems to be a good solution, but in fact the unbalancing weight of the hanged notebook may render the rolling luggage to easily fall down and cause serious damage to the notebook computer's electronic components.

SUMMARY OF THE PRESENT INVENTION

The main object of the present invention is to provide a rolling luggage with a detachable notebook carrier bag, wherein the notebook carrier bag can be firmly mounted to a front side of the rolling luggage so as to transport the notebook carrier bag with the rolling luggage as a single piece of luggage.

Another object of the present invention is to provide a rolling luggage with a detachable notebook carrier bag, wherein the attachment of the notebook carrier bag to the rolling luggage is so simple and easy that the user not only may rapidly connect the notebook carrier bag with the rolling luggage to form a single piece of luggage, but also can detach the notebook carrier bag from the rolling luggage within seconds.

Another object of the present invention is to provide a rolling luggage with a detachable notebook carrier bag, wherein the overall weight of the rolling luggage with the notebook carrier bag attached thereto is in well balance condition.

Accordingly, in order to accomplish the above objects, the present invention provides a rolling luggage with a notebook carrier bag detachably attached to a front side of the rolling luggage. The rolling luggage comprises a luggage bag, rolling wheels rotatably mounted at bottom of the luggage bag, and a carrier device attached to a rear side of the luggage bag, wherein the carrier device comprises an extensible handle bar unit that can be upwardly extended for easy handling. The rolling luggage further comprises at least a first fastening means secured at a top side of the luggage bag.

The notebook carrier bag comprises a base supporting panel, a first and a second carrying container provided on an outer surface of the base supporting panel, a first U-shaped carrying handle and a second U-shaped carrying handle respectively attached to two longitudinal ends of the notebook carrier bag, and a first connector secured to one end of the notebook carrier bag for detachably connecting with the first fastening means so as to combine the notebook carrier bag with the rolling luggage to form a single piece of luggage during traveling and transportation.

Normally, the notebook carrier bag can be detached from the rolling luggage, wherein since the first carrying container and the second carrying container are foldably connected together, the first carrying container and the second carrying container can be folded up overlappedly to form an independent notebook carrier bag. Moreover, the first and second carrying handles can join and form a handle means for the notebook carrier bag.

DETAILED DESCRIPTION OF THE PREFERRED EMBODIMENT

Referring to FIGS. 1 to 4 of the drawings, a rolling luggage 10 with a detachable notebook carrier bag 20 according to a preferred embodiment of the present invention is illustrated.

Figure 1:
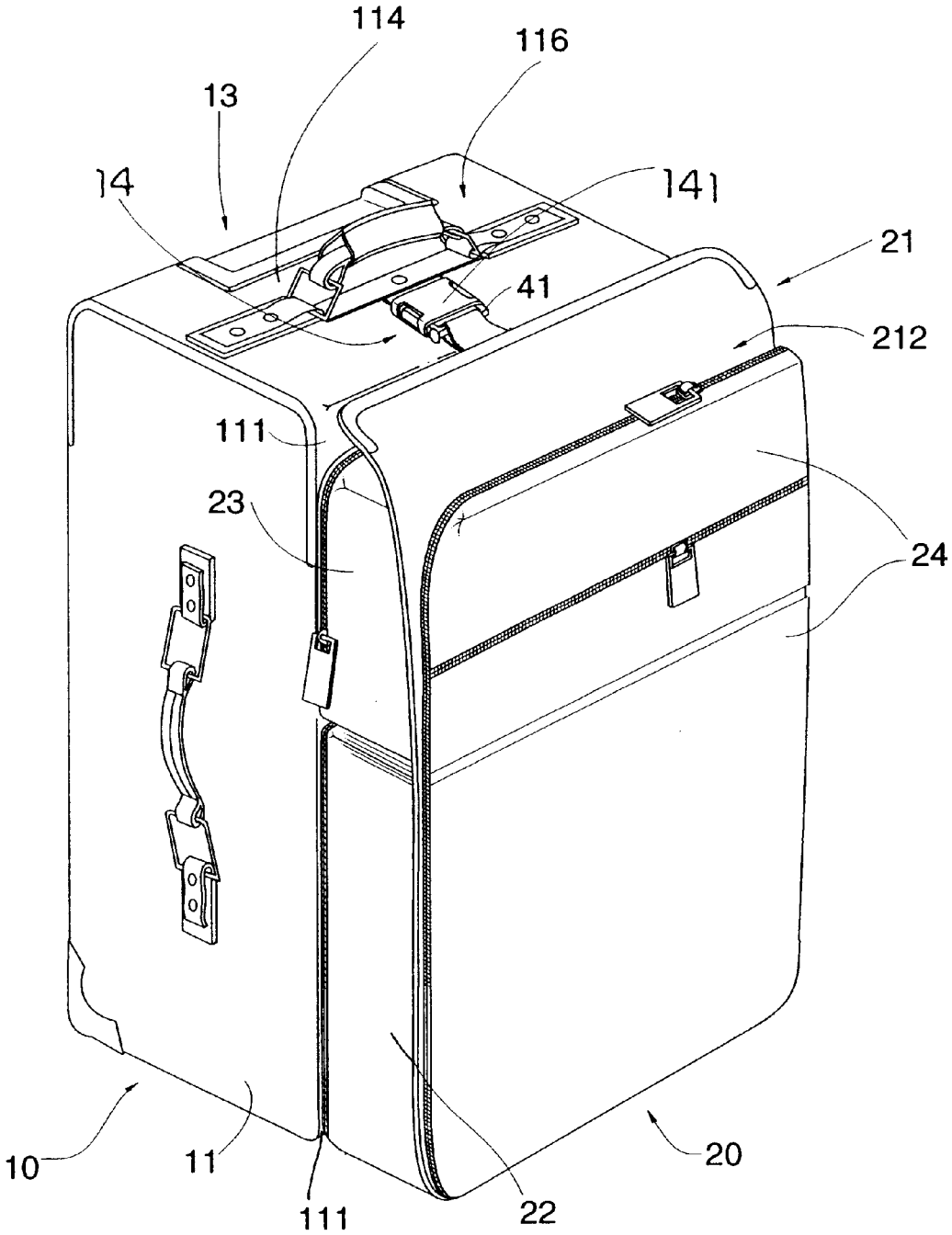
FIG. 1 is a perspective view of a rolling luggage with a detachable notebook carrier bag according to a preferred embodiment of the present invention, wherein the notebook carrier bag is attached to the rolling luggage to form a single piece of luggage.
Figure 2:
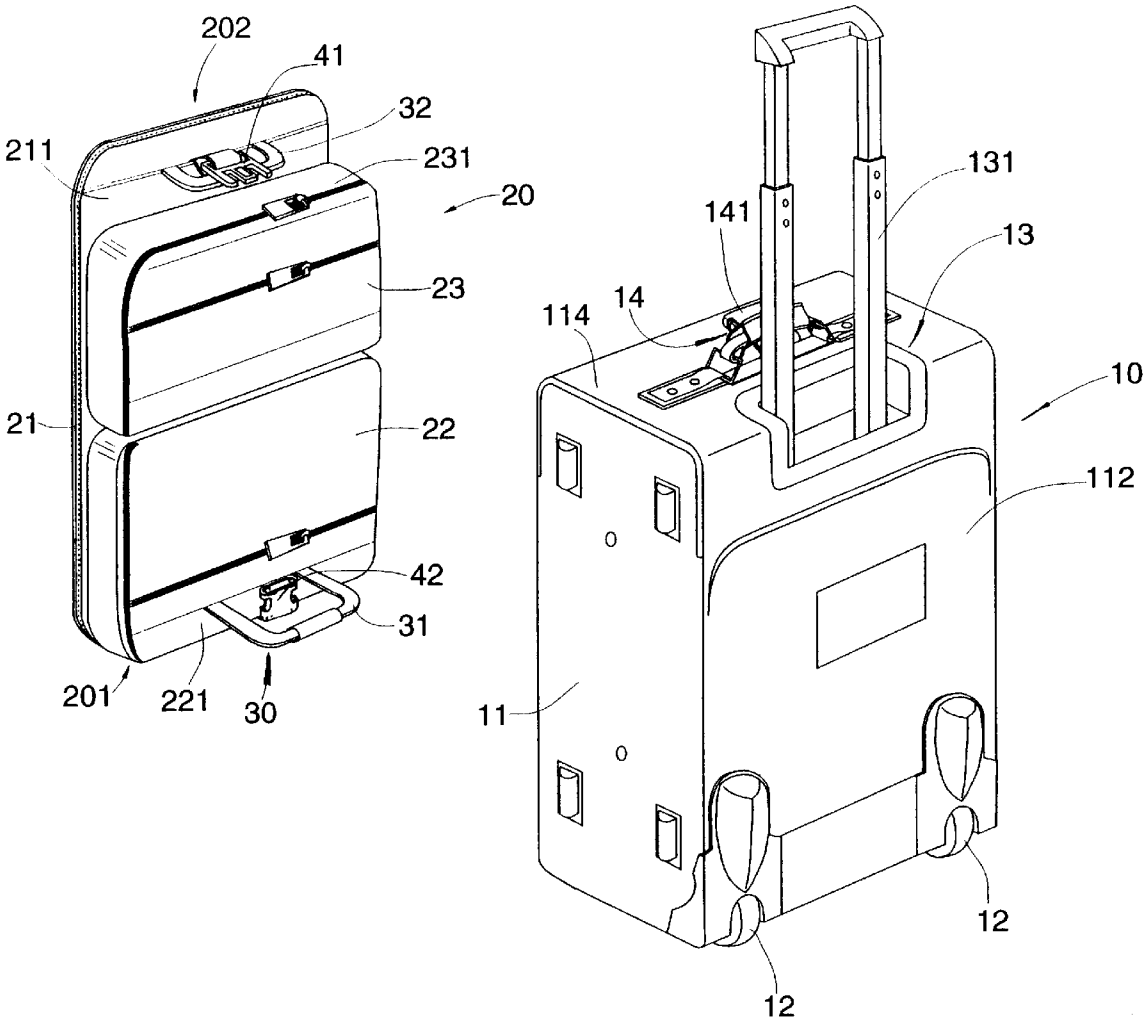
FIG. 2 is another perspective view illustrating the rolling luggage and the notebook carrier bag detached from the rolling luggage according to the above preferred embodiment of the present invention.

Referring to FIG. 1, the notebook carrier bag 20 is detachably attached to a front side 111 of the rolling luggage 10. As shown in FIGS. 1 and 2, the rolling luggage 10 comprises a luggage bag 11, a pair of rolling wheels 12 rotatably mounted at a bottom of the luggage bag 11, and a carrier device 13 attached to a rear side 112 of the luggage bag 11. As shown in FIG. 2, the carrier device 13 comprises an extensible handle bar unit 131 that can be upwardly extended for easy handling. The rolling luggage 10, according to the present invention, further comprises a first fastening means 14 secured at a top side 114 of the luggage bag 11 (as shown in FIGS. 1 and 2).

The notebook carrier bag 20 has a specifically designed structure adapted for detachably attached to the rolling luggage 10 as described above. According to the preferred embodiment of the present invention, as shown in FIGS. 1, 2, 4, and 5, the notebook carrier bag 20 comprises a base supporting panel 21 having a size approximately equal to a size of the front side 111 of the luggage bag 11, a first carrying container 22 attached on a first half of an inner surface 211 of the base supporting panel 21, and a second carrying container 23 attached on a second half of the inner surface 211 of the base supporting panel 21, wherein the first carrying container 22 and the second carrying container 23 are preferred to be arranged side by side. A notebook computer and its accessories can be stored and carried inside the first and second carrying containers 22, 23 respectively. Moreover, at least one front side bag 24 can also be provided on an outer surface 212 of the base supporting panel 21 for storing documents.

The notebook carrier bag 20 further comprises a handle means 30 for carrying when the notebook carrier bag 20 is detached from the rolling luggage 10. The handle means 30 comprises a first U-shaped carrying handle 31 and a second U-shaped carrying handle 32 respectively attached to a first end 201 and a second end 202 of the notebook carrier bag 20. According to the preferred embodiment of the present invention, two ends of the first U-shaped carrying handle 31 is affixed on an outer side portion 221, at a position near the first end 201, of the first carrying container 22 while two ends of the second U-shaped carrying handle 32 is affixed on an outer side portion 231, at a position near the second end 202, of the second carrying container 23. A first connector 41 is secured to the second end 202 of the notebook carrier bag 20.

As shown in FIG. 1, during travelling or transportation, the notebook carrier bag 20 can be attached to the front side 111 of the rolling luggage 10 by fastening the first connector 41 with the first fastening means 14 at the top side 114 of the luggage bag 11, thereby the base supporting panel 21 is downwardly hanged and covered on top of the front side 111 of the luggage bag 11 of the rolling luggage 10, wherein the first and second carrying bags 22, 23 are placed and protected between the front side 111 of the luggage bag 11 and the base supporting panel 21.

Figure 3:
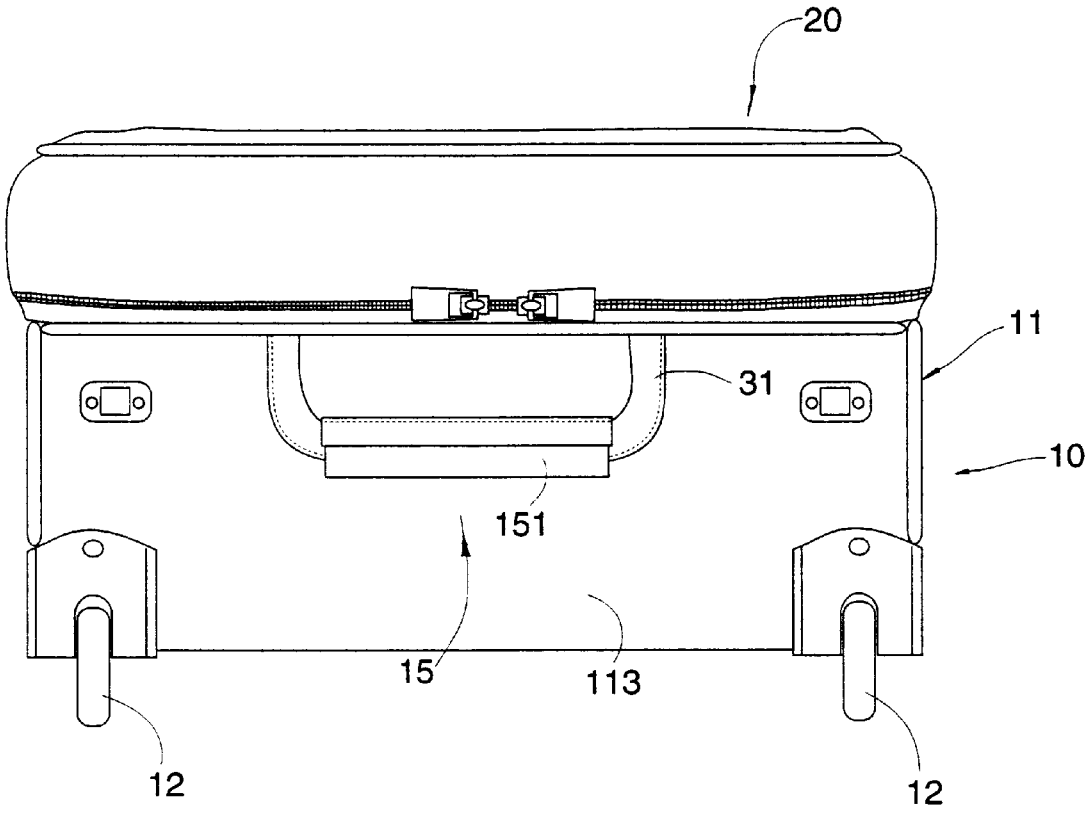
FIG. 3 is a bottom view of the rolling luggage as shown in FIG. 1 according to the above preferred embodiment of the present invention.
Figure 4:
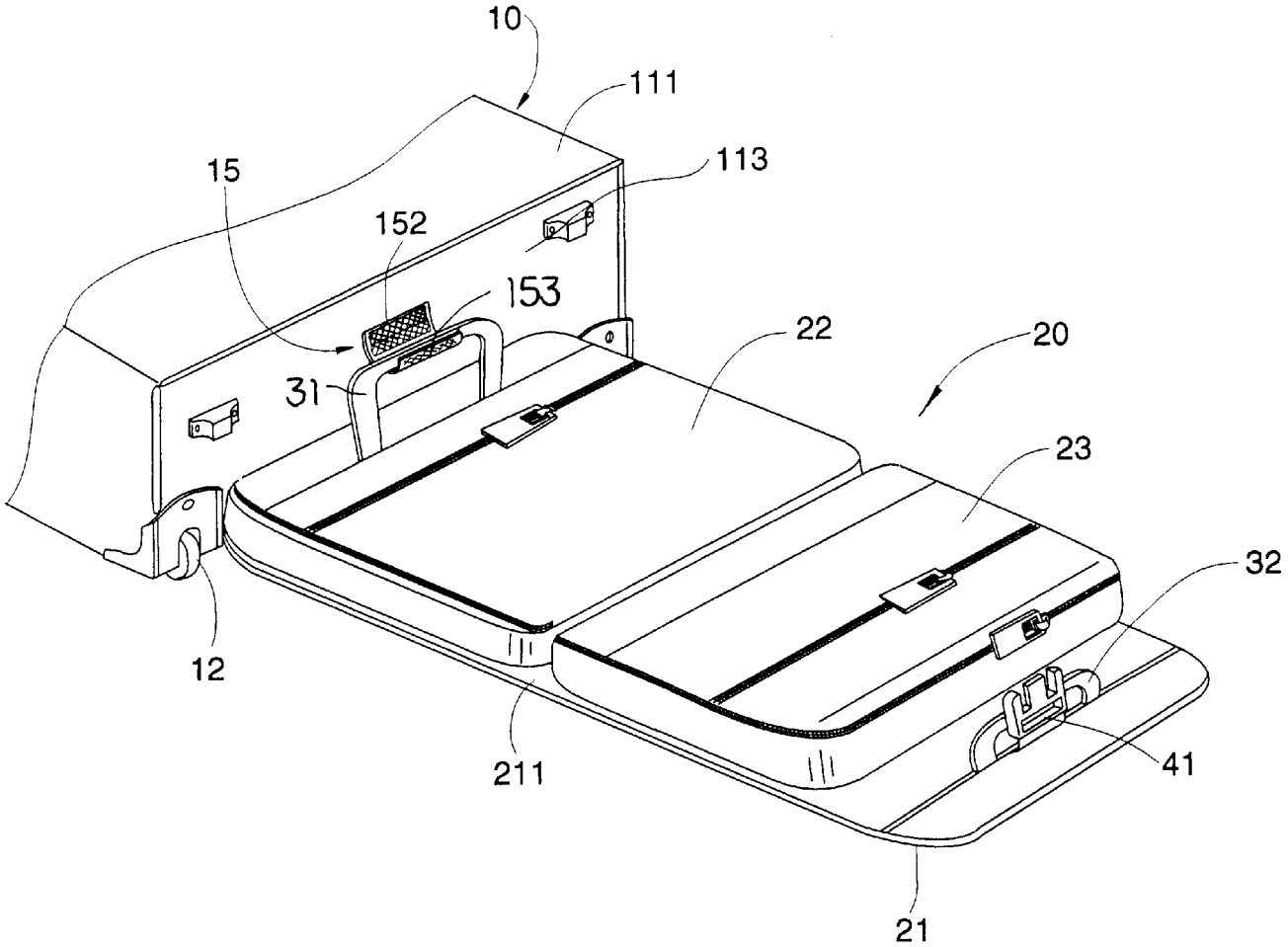
FIG. 4 is a partial sectional perspective view of the above preferred embodiment of the present invention, illustrating how the first carrying strap is detachably connected with the first fastening means at the bottom side of the luggage bag.

According to the preferred embodiment of the present invention, in order to ensure the notebook carrier bag 20 being firmly connected to the rolling luggage 10, the rolling luggage 10 further comprises a second fastening means 15 connected at a bottom side 113 of the luggage bag 11 (as shown in FIGS. 3 and 4) for connecting with the first U-shaped carrying handle 31 so as to tightly mounted the notebook carrier bag 20 on the rolling luggage 10.

As shown in FIGS. 3 and 4, according to the preferred embodiment of the present invention, the second fastening means 15 comprises a gripping holder 151 affixed to a central portion of the bottom side 113 of the luggage bag 11 for tightening up the first U-shaped carrying handle 31. A first fastener 152 such as a hook fastener and a second fastener 153 such as a loop fastener are provided on two ends of the gripping holder 151, so that by connecting the first and second fasteners 152, 153 together, the first U-shaped carrying handle 31 is gripped by the gripping holder 151 and firmly connected to the bottom side 113 of the luggage bag 11.

As shown in FIGS. 1 and 2, the first fastening means 14 comprises at least a buckle socket 141 connected to a central position of a luggage handle arrangement 116 affixed on the top side 114 of the luggage bag 11. Moreover, the first connector 41 is a buckle plug adapted for plugging into the buckle socket 141 so as to tighten up the notebook carrier bag 20 to the luggage bag 11 of the rolling luggage 10.

Figure 5:
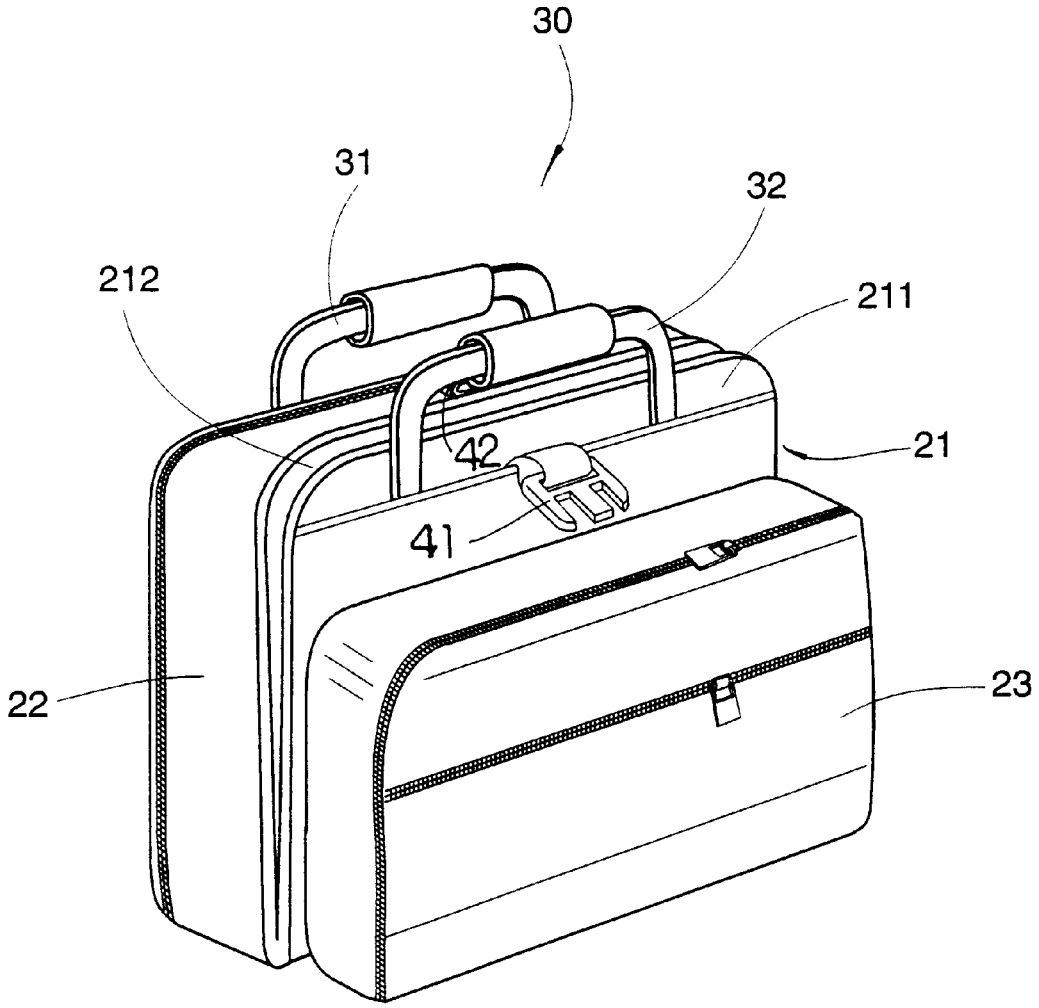
FIG. 5 is a perspective view illustrating the notebook carrier bag independently according to the above preferred embodiment of the present invention.

As shown in FIGS. 2 and 5, it is so easy to detach the notebook carrier bag 20 from the rolling luggage 10. First, unbuckle the first connector 41 from the buckle socket 141. Second, unfasten the first and second fasteners 152, 153 of the gripping holder 151 so as to separate the first U-shaped carrying handle 31 of the notebook carrier bag 20 from bottom side 113 of the luggage bag 11, as shown in FIG. 4. Then, the notebook carrier bag 20 is entirely detached from the rolling luggage 10, as shown in FIG. 2. For easy carrying, as shown in FIG. 5, the user can further fold up the base supporting panel 21 until the first and second carrying containers 22, 23 are overlapped with each other to form an independent notebook carrier bag. Also, the first and second carrying handles 31, 32 join and form the handle means 30 for the notebook carrier bag 20 for easy holding. In other words, the notebook carrier bag 20 is designed for the user's daily use of receiving and carrying the notebook computer. When the user needs to travel, the user can simply attach the notebook carrier bag 20 to the rolling luggage 10 according the present invention. After the user arrives at the designated place, the user may detach the notebook carrier bag 20 for carrying the notebook computer therein to any desired working location.

As shown in FIG. 2, a second connector 42 can be optionally affixed to the first end of the notebook carrier bag 20. The second connector 42 is preferred to be a buckle socket like the first fastening means 14, so that when the notebook carrier bag 20 is folded up, as shown in FIG. 5, the second connector 42 can be connected with the first connector 41 so as to connect the first and second carrying containers 22, 23 together. Furthermore, in view of the present invention, it is an apparent modification of substituting the gripping holder 15 with a buckle plug (like the first connector 41) for directly connecting with the second connector 42 when combining the notebook carrier bag 20 with the rolling luggage.

What is claimed is:

1. A rolling luggage arrangement, comprising:

a rolling luggage which comprises a luggage bag, rolling wheels rotatably mounted at a bottom of said luggage bag, and a carrier device attached to a rear side of said luggage bag, wherein said carrier device comprises an extensible handle bar unit adapted to be upwardly extended for easy handling said rolling luggage;

a first fastening means secured at a top side of said luggage bag;

a notebook carrier bag adapted for detachably attached to a front side of luggage bag of said rolling luggage, wherein said notebook carrier bag comprises a base supporting panel having a size adapted to cover said front side of said luggage bag, a first carrying container attached on a first half of an inner surface of said base supporting panel, a second carrying container attached on a second half of said inner surface of said base supporting panel, wherein said first carrying container and said second carrying container are arranged side by side on said inner surface of said base supporting panel, a handle means for carrying said notebook carrier bag, wherein said handle means comprises a first U-shaped carrying handle and a second U-shaped carrying handle respectively attached to a first end and a second end of said notebook carrier bag, and a first connector secured to one longitudinal end of said notebook carrier bag for detachably fastening with said first fastening means at said top side of said luggage bag, so as to hang said base supporting panel downwardly to cover on top of said front side of said luggage bag of said rolling luggage, wherein said first and second carrying bags are placed and protected between said front side of said luggage bag and said base supporting panel; moreover, for easy carrying, when said notebook carrier bag is detached from said rolling luggage, said base supporting panel of said notebook carrier bag is capable of folding up until said first carrying container and said second carrying container are overlapped with each other; and a second fastening means connected at a bottom side of said luggage bag for connecting with said first U-shaped carrying handle so as to tightly mounted said notebook carrier bag on said rolling luggage.

2. A rolling luggage arrangement, as recited in claim 1, wherein said second fastening means comprises a gripping holder affixed to a central portion of said bottom side of said luggage bag for tightening up said first U-shaped carrying handle, and a first fastener and a second fastener are provided on two ends of said gripping holder, wherein by connecting said first and second fasteners together, said first U-shaped carrying handle is gripped by said gripping holder and firmly connected to said bottom side of said luggage bag.

3. A rolling luggage arrangement, comprising:

a rolling luggage which comprises a luggage bag, rolling wheels rotatably mounted at a bottom of said luggage bag, and a carrier device attached to a rear side of said luggage bag, wherein said carrier device comprises an extensible handle bar unit adapted to be upwardly extended for easy handling said rolling luggage;

a first fastening means secured at a top side of said luggage bag;

a notebook carrier bag adapted for detachably attached to a front side of luggage bag of said rolling luggage, wherein said notebook carrier bag comprises a base supporting panel having a size adapted to cover said front side of said luggage bag, a first carrying container attached on a first half of an inner surface of said base supporting panel, a second carrying container attached on a second half of said inner surface of said base supporting panel, wherein said first carrying container and said second carrying container are arranged side by side on said inner surface of said base supporting panel, a handle means for carrying said notebook carrier bag, and a first connector secured to one longitudinal end of said notebook carrier bag for detachably fastening with said first fastening means at said top side of said luggage bag, so as to hang said base supporting panel downwardly to cover on top of said front side of said luggage bag of said rolling luggage, wherein said first and second carrying bags are placed and protected between said front side of said luggage bag and said base supporting panel; moreover, for easy carrying, when said notebook carrier bag is detached from said rolling luggage, said base supporting panel of said notebook carrier bag is capable of folding up until said first carrying container and said second carrying container are overlapped with each other, wherein said first fastening means comprises at least a buckle socket connected to said top side of said luggage bag, and said first connector is a buckle plug adapted for plugging into said buckle socket so as to tighten up said notebook carrier bag to said luggage bag of said luggage bag, wherein said handle means comprises a first U-shaped carrying handle and a second U-shaped carrying handle respectively attached to a first end and a second end of said notebook carrier bag; and a second fastening means connected at a bottom side of said luggage bag for connecting with said first U-shaped carrying handle so as to tightly mounted said notebook carrier bag on said rolling luggage.

4. A rolling luggage arrangement, as recited in claim 3, wherein said second fastening means comprises a gripping holder affixed to a central portion of said bottom side of said luggage bag for tightening up said first U-shaped carrying handle, and a first fastener and a second fastener are provided on two ends of said gripping holder, wherein by connecting said first and second fasteners together, said first U-shaped carrying handle is gripped by said gripping holder and firmly connected to said bottom side of said luggage bag.

5. A rolling luggage arrangement, comprising:

a rolling luggage which comprises a luggage bag, rolling wheels rotatably mounted at a bottom of said luggage bag, and a carrier device attached to a rear side of said luggage bag, wherein said carrier device comprises an extensible handle bar unit adapted to be upwardly extended for easy handling said rolling luggage;

a first fastening means secured at a top side of said luggage bag;

a notebook carrier bag adapted for detachably attached to a front side of luggage bag of said rolling luggage, wherein said notebook carrier bag comprises a base supporting panel having a size adapted to cover said front side of said luggage bag, a first carrying container attached on a first half of an inner surface of said base supporting panel, a second carrying container attached on a second half of said inner surface of said base supporting panel, wherein said first carrying container and said second carrying container are arranged side by side on said inner surface of said base supporting panel, a handle means for carrying said notebook carrier bag, a first connector secured to one longitudinal end of said notebook carrier bag for detachably fastening with said first fastening means at said top side of said luggage bag, so as to hang said base supporting panel downwardly to cover on top of said front side of said luggage bag of said rolling luggage, wherein said first and second carrying bags are placed and protected between said front side of said luggage bag and said base supporting panel; moreover, for easy carrying, when said notebook carrier bag is detached from said rolling luggage, said base supporting panel of said notebook carrier bag is capable of folding up until said first carrying container and said second carrying container are overlapped with each other; and a second connector affixed to another longitudinal end of said notebook carrier bag which is adapted to connect with said first connector when said notebook carrier bag is folded up.

6. A rolling luggage arrangement, comprising:

a rolling luggage which comprises a luggage bag, rolling wheels rotatably mounted at a bottom of said luggage bag, and a carrier device attached to a rear side of said luggage bag, wherein said carrier device comprises an extensible handle bar unit adapted to be upwardly extended for easy handling said rolling luggage;

a first fastening means secured at a top side of said luggage bag;

a notebook carrier bag adapted for detachably attached to a front side of luggage bag of said rolling luggage, wherein said notebook carrier bag comprises a base supporting panel having a size adapted to cover said front side of said luggage bag, a first carrying container attached on a first half of an inner surface of said base supporting panel, a second carrying container attached on a second half of said inner surface of said base supporting panel, wherein said first carrying container and said second carrying container are arranged side by side on said inner surface of said base supporting panel, a handle means for carrying said notebook carrier bag, wherein said handle means comprises a first U-shaped carrying handle and a second U-shaped carrying handle respectively attached to a first end and a second end of said notebook carrier bag, and a first connector secured to one longitudinal end of said notebook carrier bag for detachably fastening with said first fastening means at said top side of said luggage bag, so as to hang said base supporting panel downwardly to cover on top of said front side of said luggage bag of said rolling luggage, wherein said first and second carrying bags are placed and protected between said front side of said luggage bag and said base supporting panel; moreover, for easy carrying, when said notebook carrier bag is detached from said rolling luggage, said base supporting panel of said notebook carrier bag is capable of folding up until said first carrying container and said second carrying container are overlapped with each other, wherein said first fastening means comprises at least a buckle socket connected to said top side of said luggage bag, and said first connector is a buckle plug adapted for plugging into said buckle socket so as to tighten up said notebook carrier bag to said luggage bag of said luggage bag, and a second connector affixed to another longitudinal end of said notebook carrier bag which is adapted to connect with said first connector when said notebook carrier bag is folded up.

* * * * *